US005325894A

United States Patent [19]

Kooy et al.

[11] Patent Number: 5,325,894

[45] Date of Patent: Jul. 5, 1994

[54] METHOD AND APPARATUS FOR FUELING VEHICLES WITH LIQUEFIED NATURAL GAS

[75] Inventors: Richard J. Kooy, Western Springs; Don H. Coers, Naperville, both of Ill.

[73] Assignee: Chicago Bridge & Iron Technical Services Company, Oak Brook, Ill.

[21] Appl. No.: 117,355

[22] Filed: Sep. 7, 1993

Related U.S. Application Data

[63] Continuation of Ser. No. 986,997, Dec. 7, 1992, abandoned.

[51] Int. Cl.[5] ..... B65B 31/00; F17C 9/04

[52] U.S. Cl. ..... 141/4; 141/11; 141/18; 141/2; 141/82; 62/50.4; 62/50.2

[58] Field of Search ..... 141/1, 4, 5, 11, 2, 141/18, 82; 62/50.2, 50.3, 50.4, 45.1

[56] References Cited

U.S. PATENT DOCUMENTS

| | | | |
|---|---|---|---|
| 3,195,316 | 7/1965 | Maher et al. | 62/52 |
| 3,271,965 | 9/1966 | Maher et al. | 62/23 |
| 3,990,256 | 11/1976 | May et al. | 62/50.2 |
| 4,406,129 | 9/1983 | Mills | 62/7 |
| 4,505,249 | 3/1985 | Young | 123/527 |
| 4,527,600 | 7/1985 | Fisher et al. | 141/4 |
| 4,531,558 | 7/1985 | Engel et al. | 141/82 X |
| 4,887,857 | 12/1989 | VanOmmeren | 141/1 |
| 4,966,206 | 10/1990 | Bauman et al. | 141/4 X |
| 4,987,932 | 1/1991 | Pierson | 141/1 |
| 5,029,622 | 7/1991 | Mutter | 141/4 |
| 5,107,906 | 4/1992 | Swenson et al. | 141/11 |
| 5,121,609 | 6/1992 | Cieslukowski | 62/50.4 |
| 5,127,230 | 7/1992 | Neeser et al. | 62/7 |
| 5,163,409 | 11/1992 | Gustafson et al. | 123/525 |
| 5,211,021 | 5/1993 | Pierson | 141/11 X |
| 5,231,838 | 8/1993 | Cieslukowski | 62/50.4 |

FOREIGN PATENT DOCUMENTS

| | | | |
|---|---|---|---|
| 0219995 | 9/1988 | Japan | 141/18 |
| 1130715 | 12/1984 | U.S.S.R. | 141/4 |

*Primary Examiner*—Ernest G. Cusick

*Attorney, Agent, or Firm*—Marshall, O'Toole, Gerstein, Murray & Borun

[57] ABSTRACT

Apparatus for, and a method of, withdrawing liquefied natural gas stored in a primary insulated storage tank at a low pressure and at a temperature close to its boiling point; increasing the pressure of the withdrawn liquefied natural gas and then feeding the pressurized liquefied natural gas through a heat exchanger to warm the liquefied natural gas to a subcooled or near saturated liquid condition at a temperature of about −220° F. to −126° F. when at a pressure of about 50 psig to 550 psig; and feeding the said warmed and pressurized liquefied natural gas to an insulated tank on a vehicle at a refueling facility, said vehicle using liquefied natural gas as its fuel and the insulated vehicle fuel tank being adapted to safely contain and store the said liquefied natural gas in liquid form, at an approximate saturated condition at a temperature of about −220° F. to −126° F. and a pressure of about 50 psig to 550 psig.

20 Claims, 2 Drawing Sheets

METHOD AND APPARATUS FOR FUELING VEHICLES WITH LIQUEFIED NATURAL GAS

This is a continuation of U.S. application Ser. No. 07/986,997, filed Dec. 7, 1992, now abandoned.

This invention relates to the storage and dispensing of fluid fuels used to fuel engines. More particularly, this invention is concerned with apparatus and methods for storing and dispensing liquefied natural gas (LNG) or liquid methane as a fuel for engines in vehicles of all types.

BACKGROUND OF THE INVENTION

Because of the increased costs of liquid fuels, such as gasoline and diesel fuel, as the energy source for engines in automobiles, trucks, buses, boats, ships, aircraft, tractors and off-the-road construction equipment such as cranes, earth movers and bulldozers, all of which are considered to be vehicles for the purpose of this invention, there has been increased interest in using natural gas to fuel such engines. Also, in many areas of the world natural gas is abundantly available while petroleum products such as gasoline and diesel fuel are very scarce and expensive. Additionally, natural gas fueled engines generally produce combustion products which have a much lower polluting effect than do gasoline and diesel fuel.

Because natural gas at ambient temperature and atmospheric pressure has a relatively low volumetric energy content it is not practical to store it at these conditions in a vehicle fuel tank. Therefore, it is customary to store the natural gas in a fuel tank under very high pressures of about 2000 to 4000 psig. See Swenson et al U.S. Pat. No. 5,107,906; Pierson U.S. Pat. No. 4,987,932; Fisher et al U.S. Pat. No. 4,527,600 and Young U.S. Pat. No. 4,505,249.

It has been previously proposed to store a cryogenic liquid fuel, such as liquefied natural gas, in an insulated fuel tank at a saturated thermodynamic state wherein the liquid is in equilibrium with the vapor. Mills U.S. Pat. No. 4,406,129 discloses a cryogenic liquid fuel in a vehicle tank and the use of the liquid and vapor to fuel a vehicle engine. However, this patent does not disclose the source of the cryogenic liquid fuel, how it was dispensed or filled into the vehicle tank or its temperature and pressure in the tank.

It has been recognized for many years that a very practical way to store bulk quantities of liquefied gases in a tank is at low pressures and low temperatures. For example, liquefied natural gas may be stored at a pressure of about 15 psig to 45 psig and a temperature of about −242° F. to −222° F. See Maher et al U.S. Pat. No. 3,195,316. Storing liquefied natural gas at such a low pressure in a vehicle tank, however, may be undesirable because the low pressure may be unsuitable for practical operation of some engines, particularly fuel injected engines. A need accordingly exists for improved apparatus and methods of filling a vehicle fuel tank with liquefied natural gas.

SUMMARY OF THE INVENTION

According to the invention, a method is provided comprising withdrawing liquefied natural gas stored in a primary insulated storage tank at a low pressure and at a temperature close to its boiling point; withdrawing and pressurizing or pumping liquefied natural gas from the tank through a heat exchanger to warm the pressurized liquefied natural gas to a subcooled or near saturated liquid condition at a temperature of about −220° F. to −126° F., corresponding to a pressure of about 50 psig to 550 psig; and feeding the said warmed and pressurized liquefied natural gas to an insulated fuel tank on a vehicle at a refueling facility, said vehicle using liquefied natural gas as its fuel and the insulated vehicle tank being adapted to safely contain and store the said liquefied natural gas in liquid form at about −220° F. to −126° F. corresponding to a pressure of about 50 psig to 550 psig.

The liquefied natural gas in the primary insulated storage tank desirably is at about 15 psia to 45 psia and a temperature of about −258° F. to −230° F.

As used herein "liquefied natural gas" is intended to include liquid methane.

Natural gas vapor which accumulates in the primary insulated storage tank can be withdrawn by a compressor and combined with the liquefied natural gas withdrawn from the primary insulated storage tank to form a combined stream which is then fed through the heat exchanger. This maximizes the amount of fuel effectively used and minimizes gas emissions to the environment.

The invention also includes a second embodiment of the method comprising withdrawing and pressurizing or pumping liquefied natural gas stored in a primary insulated storage tank at a low pressure and at a temperature close to its boiling point; feeding the withdrawn and pressurized liquefied natural gas through a heat exchanger to warm the pressurized liquefied natural gas to a near saturated temperature of about −220° F. to −126° F. and corresponding pressure of about 50 psig to 550 psig; feeding the warmed and pressurized liquefied natural gas to a stationary insulated natural gas dispensing tank at a vehicle liquefied natural gas refueling facility and storing the liquefied natural gas in the dispensing tank in an approximate saturated condition at a temperature of about −220° F. to −126° F. and a pressure of about 50 psig to 550 psig; and upon arrival of a vehicle at the refueling facility, said vehicle using liquefied natural gas as its fuel and being equipped with an insulated vehicle fuel tank adapted to safely contain and store liquefied natural gas in liquid form, transferring liquefied natural gas from the dispensing tank to the vehicle tank so that the liquefied natural gas is in a near saturated liquid condition at a temperature of about −220° F. to −126° F. and a pressure of about 50 psig to 550 psig.

Excess vapor which forms in the dispensing tank can be returned to the primary insulated storage tank, reducing gas emissions to the environment. Also, liquefied natural gas can be withdrawn from the primary storage tank and be fed directly into admixture with liquefied natural gas withdrawn from the dispensing tank to form a blended mixture which is fed to the vehicle tank.

Also provided by the invention is apparatus comprising a primary insulated storage tank containing liquefied natural gas at a low pressure and at a temperature close to its boiling point; a heat exchanger; a conduit communicating with the liquefied natural gas in the primary tank and with a heat exchanger, said conduit including a pump, for withdrawing liquefied natural gas from the primary tank, increasing the pressure of the withdrawn liquefied natural gas and feeding it to the heat exchanger wherein the pressurized liquefied natural gas is warmed to a subcooled or near saturated temperature of about −220° F. to −126° F. and a corresponding pressure of about 50 psig to 550 psig; a vehicle using liquefied natural gas as its fuel and having an insulated vehicle fuel tank on board for receiving warmed pressurized liquefied natural gas and maintaining a substantial amount of it liquid until utilized as fuel; and a conduit communicating with the heat exchanger and the vehicle fuel tank for receiving the warmed pressurized liquefied natural gas from the heat exchanger and feeding it to the vehicle fuel tank for storage as a liquid therein at a temperature of about −220° F. to −126° F. and a corresponding pressure of about 50 psig to 550 psig and at an approximate saturated condition.

The primary storage tank can have a natural gas vapor space; a natural gas vapor withdrawal conduit can communicate with the primary tank vapor space and with the conduit communicating with the primary tank and with the heat exchanger; and the conduit can include a vapor compressor to move the vapor to the heat exchanger.

The invention also provides a second apparatus embodiment comprising a primary insulated storage tank containing liquefied natural gas at a low pressure and at a temperature close to its boiling point; a heat exchanger; a conduit communicating with the liquefied natural gas in the primary tank and with a heat exchanger, said conduit including a pump, for withdrawing pressurized liquefied natural gas from the primary tank, increasing the pressure of the withdrawn liquefied natural gas and feeding it to the heat exchanger wherein the pressurized liquefied natural gas is warmed to a temperature of about −220° F. to −126° F. and a pressure of about 50 psig to 550 psig and so that the liquefied natural gas is near a saturated liquid condition; a stationary insulated natural gas dispensing tank located at a vehicle liquefied natural gas refueling facility; a conduit for feeding the warmed and pressurized liquefied natural gas from the heat exchanger to the stationary insulated natural gas dispensing tank for storage in the said dispensing tank at an approximate saturated condition and at a temperature of about −220° F. to −126° F. and a pressure of about 50 psig to 550 psig; a vehicle using liquefied natural gas as its fuel and having an insulated fuel tank on board for receiving liquefied natural gas and maintaining a substantial amount of it liquid until utilized as fuel; and a conduit communicating with the dispensing tank and the vehicle fuel tank for receiving warmed liquefied natural gas from the dispensing tank and feeding it to the vehicle fuel tank for storage therein at a temperature of about −220° F. to −126° F. and a pressure of about 50 psig to 550 psig and at an approximate saturated condition.

The primary storage tank can have a natural gas vapor space; and a natural gas vapor withdrawal conduit, said conduit including a compressor, can communicate with the primary tank vapor space and also with the conduit which communicates with the liquefied natural gas in the primary tank and with the heat exchanger for combining the vapor with the liquefied natural gas.

The apparatus can include conduit means for withdrawing liquefied natural gas from the primary storage tank, pressurizing the withdrawn liquefied natural gas and feeding it into admixture with warmed liquefied natural gas withdrawn from the heat exchanger to thereby form a blended stream of warmed and pressurized liquefied natural gas to be fed either to the vehicle fuel tank or to the dispensing tank.

The apparatus can also have conduit means for withdrawing liquefied natural gas from the primary storage tank, pressurizing the withdrawn liquefied natural gas and feeding it into admixture with warmed liquefied natural gas withdrawn from the dispensing tank to thereby form a blended stream of warmed and pressurized liquefied natural gas to feed to the vehicle fuel tank. Additionally, conduit means can be included for withdrawing natural gas vapor from the dispensing tank and returning it to the primary storage tank.

DETAILED DESCRIPTION OF THE DRAWINGS

To the extent it is reasonable and practical the same or similar elements which appear in the various drawing figures will be illustrated by the same numbers.

Figure 1:
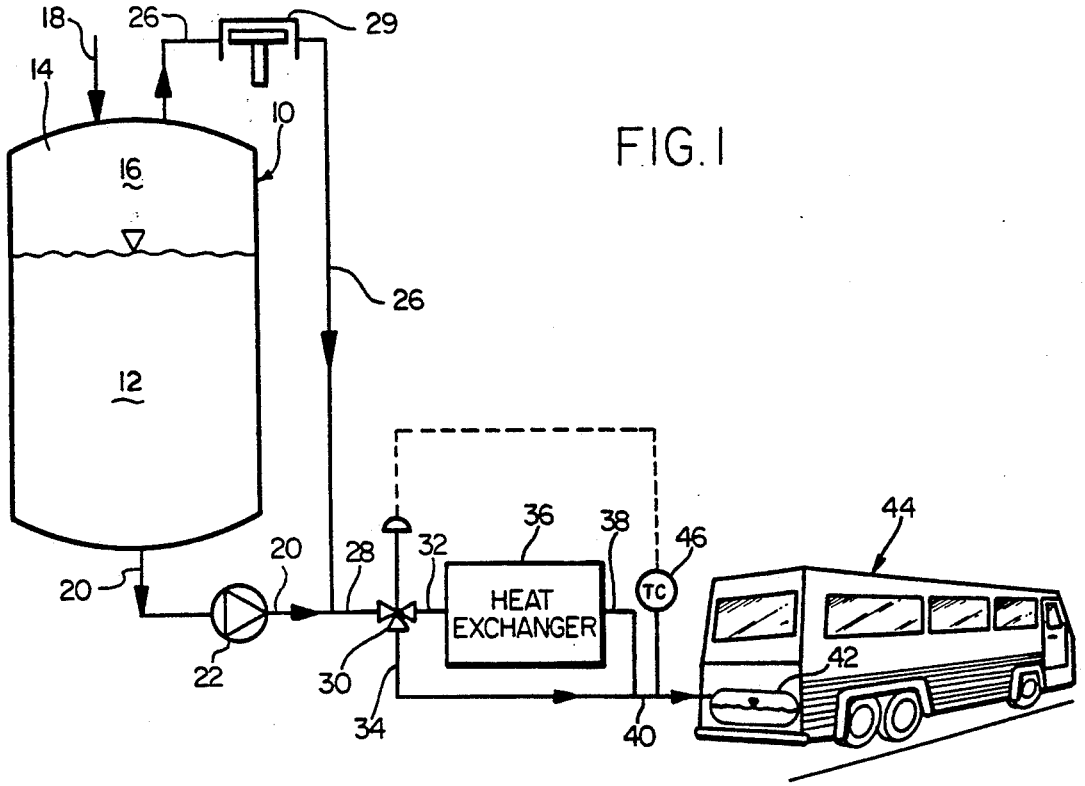
FIG. 1 diagrammatically illustrates a first embodiment of apparatus useful in practicing the invention.

With reference to FIG. 1, which illustrates a first embodiment of the invention, the insulated primary tank 10 is constructed of suitable material so as to safely store a volume of liquefied natural gas or methane 12 at a relatively low pressure, for example at about 15 psig to 45 psig and corresponding saturation temperature of about −242° F. to −222° F. A vapor space 14 in the upper part of primary tank 10 is provided so as to accumulate vapor 16 which forms as a result of heat flow from the atmosphere into the tank. Conduit 18 communicates with the interior of tank 10 and provides a means for filling the tank with liquefied natural gas.

Conduit 20 communicates with the lower interior space of tank 12 and with heat exchanger 36. Pump 22 is located in conduit 20. Conduit 20 thus provides a means for withdrawing a stream of liquefied natural gas from primary tank 10 and feeding it to the heat exchanger 36.

Natural gas vapor which accumulates in vapor space 16 is optionally, but not necessarily, withdrawn therefrom through conduit 26 which communicates with the vapor space and with conduit 20 upstream of the heat exchanger 36 but downstream of pump 22. Vapor pump or compressor 29 is provided in conduit 26 to increase the pressure of the vapor fed to conduit 20. By blending the vapor stream from conduit 26 into admixture with the liquefied natural gas stream in conduit 20 the vapor is condensed and the liquid is slightly warmed.

The liquefied natural gas stream is then delivered by conduit 20 to conduit 28 which communicates with and feeds the liquid to control valve 30. Conduit 32 communicates upstream with control valve 30 and downstream with heat exchanger 36. Also, conduit 34 communicates with control valve 30 and with conduit 40 which communicates with vehicle fuel tank 42. The liquefied natural gas is fed from conduit 32 into the inlet side of heat exchanger 36. As it flows through the heat exchanger 36 the liquefied natural gas is raised to a higher temperature and which may approach saturated condition, such as to about −220° F. to −126° F. at corresponding pressure of about 50 psig to 550 psig. The heat needed to raise the temperature of the liquefied natural gas can be indirectly supplied by ambient or heated air or water, or any other suitable heat exchange fluid, which can be fed to the heat exchanger at a flow rate which will raise the liquefied natural gas temperature to the extent desired, eliminating the need for bypass conduit 34.

The warmed liquefied natural gas is withdrawn from the heat exchanger 36 by conduit 38 and is fed to conduit 34. The combined streams of liquefied natural gas from conduits 34 and 38 are fed to conduit 40, the end of which is in temporary and removable communication with insulated vehicle fuel tank 42 located at the rear of bus 44. The warmed liquefied natural gas is fed from conduit 40 into insulated fuel tank 42 until the tank 42 is essentially filled. Pump 22 is then stopped, and the downstream end of conduit 40 is removed from vehicle fuel tank 42 and the tank 42 is capped.

The temperature of the liquefied natural gas fed through conduit 40 is controlled by temperature controller 46 which regulates control valve 30. The amount of liquefied natural gas proportioned by control valve 30 between conduits 32 and 34 serves to regulate the temperature and pressure of the liquefied natural gas stream fed to the vehicle fuel tank 42.

Figure 2:
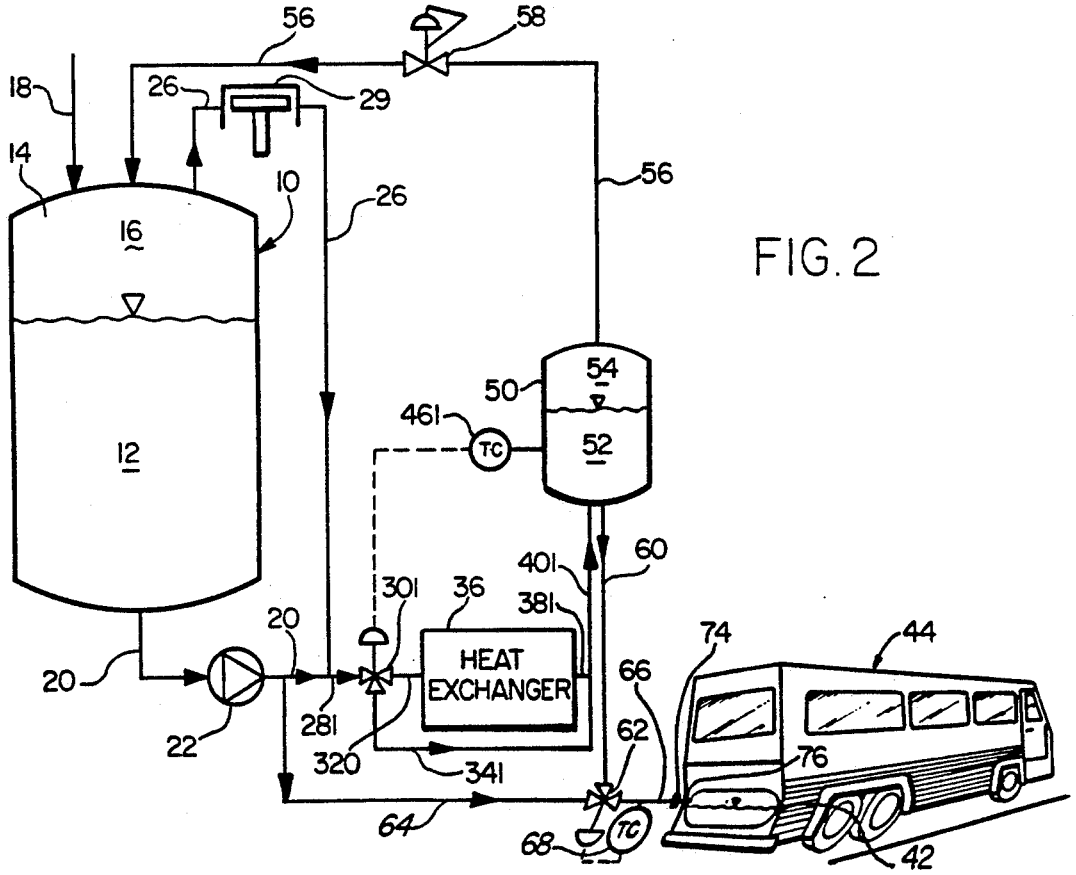
FIG. 2 diagrammatically illustrates a second embodiment of apparatus useful in practicing the invention.

FIG. 2 illustrates a second embodiment of the invention. It will be readily seen that this embodiment incorporates the tank 10 and heat exchanger 36 as well as many of the conduits, pump 22 and compressor 29 forming part of the first embodiment shown in FIG. 1. However, in the second embodiment shown in FIG. 2, the conduits 20 and 26 deliver their respective fluid streams to conduit 281, which is comparable to conduit 28. The conduit 281 communicates with and delivers the resulting stream of liquefied natural gas to control valve 301, which is comparable to control valve 30.

Conduit 320 communicates with control valve 301 and heat exchanger 36 and serves to feed a stream of cold liquefied natural gas from the control valve 301 to the heat exchanger 36 in which the liquefied natural gas is warmed and subsequently fed therefrom into conduit 381 which feeds the stream of liquefied natural gas to conduit 401.

Conduit 341 also communicates with control valve 301 and with conduit 401. Conduit 341 provides a means for feeding cold liquefied natural gas around or past the heat exchanger 36 and into admixture with the liquefied natural gas fed by conduit 381 to conduit 401. This provides a system by which the temperature and inherently the pressure of the liquefied natural gas fed by conduit 401 to insulated dispensing tank 50 can be controlled. Thus, temperature controller 461 responds to the temperature of the liquefied natural gas 52 in dispensing tank 50 and by signal means actuates control valve 301 so that liquefied natural gas fed by conduit 281 to the control valve 301 is proportioned between conduits 320 and 341. Under appropriate circumstances the flow through conduit 320 could be from 0 to 100% of the flow in conduit 281, and the flow through conduit 341 could be from 0 to 100% of the flow in conduit 281, with the combined flow in conduits 320 and 341 equaling the flow in conduit 281.

Liquefied natural gas 52 is stored in dispensing tank 50 in a saturated condition at a temperature of about −220° F. to −126° F. and a corresponding pressure of about 50 psig to 550 psig. Vapor 54 which accumulates in the upper interior space of dispensing tank 50 is withdrawn through conduit 56 and is returned to the interior of primary storage tank 10. Pressure relief valve 58 in conduit 56 is set to open at a predetermined higher vapor pressure than the pressure normally present in the vapor space of the dispensing tank 50.

Conduit 60 communicates upstream with the lower interior space of dispensing tank 40. The downstream end of conduit 60 communicates with control valve 62 thereby permitting liquefied natural gas to flow from dispensing tank 50 to the control valve 62. Conduit 64 communicates with conduit 20 and with control valve 62, thereby permitting cold liquefied natural gas to be fed from the primary tank 10 to the control valve 62.

Liquefied natural gas exiting the control valve 62 is fed to conduit 66. The temperature of the liquefied natural gas stream flowing through conduit 66 is measured by temperature controller 68 which sends a signal to control valve 62 to properly proportion the amount of liquefied natural gas from conduit 60 and conduit 64 which is fed through the control valve 62. The amount of liquefied natural gas flowing through conduit 66 can be 0% to 100% from conduit 60 and 0 to 100% from conduit 64 depending on existing conditions.

The downstream end of conduit 66 is provided with a coupling 74 which can be removably connected to the outer end of fuel fill pipe 76 which communicates with the vehicle fuel tank 42. Liquefied natural gas at a temperature of about −220° F. to −126° F. and a pressure of about 50 psig to 550 psig can be withdrawn from dispensing tank 50 by means of conduit 60 and fed through control valve 62 to conduit 66 and by it to pipe 76 which feeds the fuel into vehicle fuel tank 42 at such time as the bus 44 is to be refueled. After the fuel tank 42 is filled the conduit 66 is uncoupled from pipe 76 and the end of pipe 76 is sealed by a cap, not shown.

The apparatus illustrated in FIG. 2 also permits an optional way to practice the invention. Thus, by means of conduit 64 very cold liquefied natural gas withdrawn from primary tank 10 can be fed into admixture in control valve 62 with the warmer liquefied natural gas supplied by conduit 60 to form a blend which can then be fed into vehicle fuel tank 42 at a temperature lower than the temperature of the liquid in the dispensing tank 50. In this manner the pressure in the dispensing tank may be kept higher than the vehicle fuel tank pressure in order to provide the motive force necessary for dispensing the liquefied fuel. This is also desirable, at times, to compensate for the warming effect exerted by a substantially empty fuel tank 42 and heat which enters the fuel during the filling operation.

Figure 3:
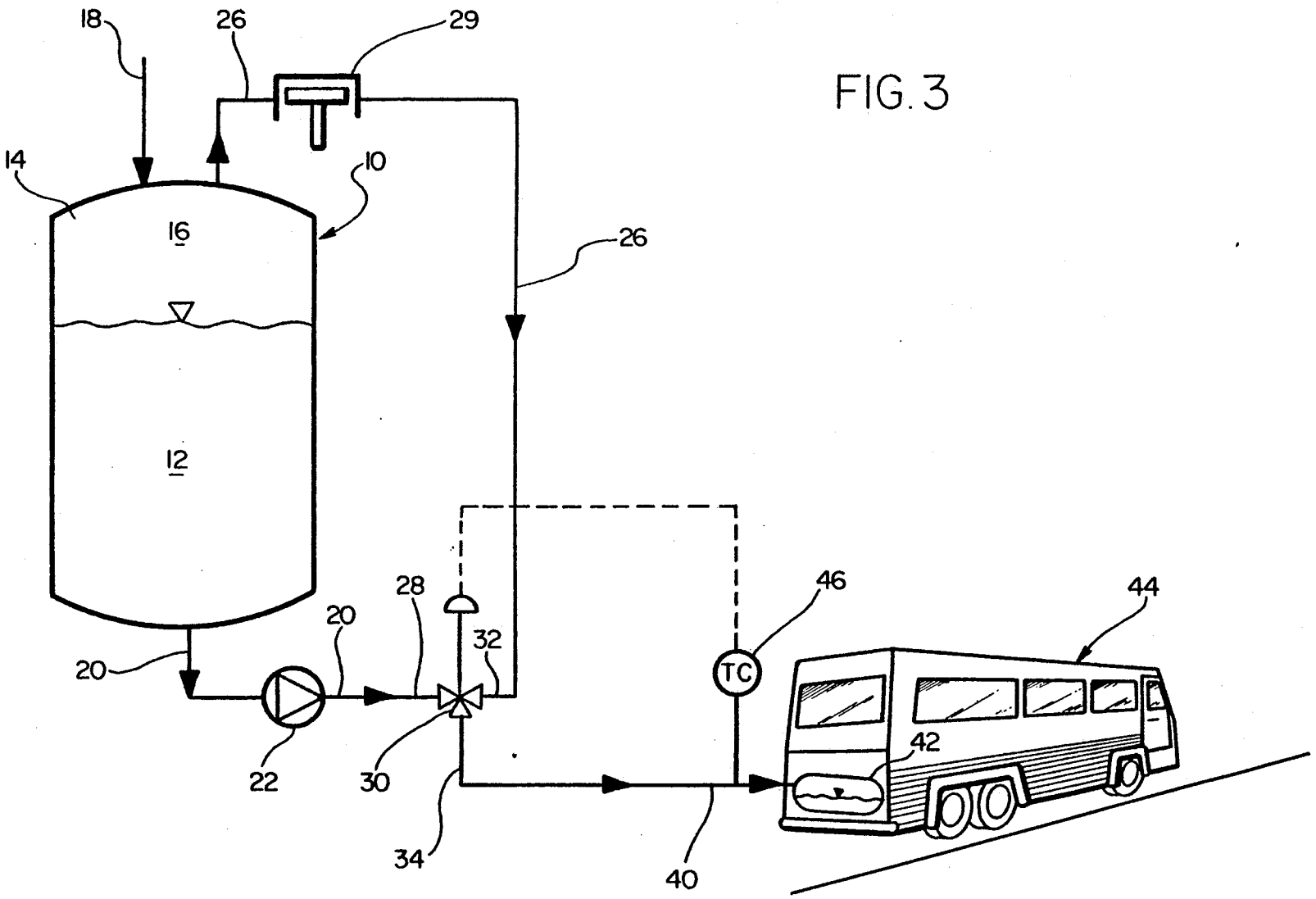
FIG. 3 diagrammatically illustrates a third embodiment of apparatus useful in practicing the invention.

The apparatus illustrated by FIG. 3 is very similar to that shown in FIG. 1. However, the apparatus of FIG. 3 does not include the indirect heat exchanger 36 forming part of the apparatus illustrated in FIG. 1.

With reference to FIG. 3, the natural gas vapor which accumulates in vapor space 16 is withdrawn therefrom through conduit 26 and feeds to conduit 32 which feds it to control valve 30. The liquefied natural gas stream is delivered by conduit 28 to control valve 30 where the vapor is condensed by direct contact with the liquefied natural gas which is thereby slightly warmed. In this embodiment the control valve 30 functions as a direct contact heat exchanger. The warmed liquefied natural gas stream is fed from control valve 30 to conduit 34 and by it to conduit 40 for delivery to vehicle tank 42. The temperature of the liquefied natural gas fed through conduit 40 is controlled by temperature controller 46 which regulates control valve 30 and the amount of liquefied natural gas fed to it by conduit 38 relative to vapor supplied by conduit 26 to control valve 30.

In the subsequent examples the composition of LNG has been assumed to be essentially 100% methane to simplify the determination of thermodynamic points.

EXAMPLE 1

A transit bus 44 stores liquefied natural gas on-board in an insulated vehicle tank 42. Fuel is removed from the vehicle tank and fed to a fuel injected internal combustion engine. Proper operation of the engine requires a pressure of 100 psig in the vehicle tank (the corresponding saturation temperature is approximately −200° F.).

At the bus fuel filling station, liquefied natural gas is stored in a large bulk storage or primary tank 10 at 30 psig (its corresponding saturation temperature is approximately −231° F.). If the vehicle tank 42 is filled with −231° F. liquid directly from the bulk storage tank, the pressure in the vehicle tank 42 will drop significantly below 100 psig, and the bus engine will not properly operate.

The bus 44 has been parked for some time, and some stratification of warm liquefied natural gas in the fuel tank 42 has occurred. Although most of the liquid in the vehicle tank 42 is at −200° F., heat leak from the atmosphere has caused a top portion of liquefied natural gas in the tank 42 to warm from −200° F. to −194° F. and the tank pressure to rise from about 100 psig to about 120 psig.

In one example of the embodiment shown in FIG. 1, liquefied natural gas is withdrawn from the bulk storage or primary tank 10 by means of conduit 20 at the saturation temperature of −231° F. and is increased in pressure by pump 22 to 140 psig. From pump 22 the cold stream flows through conduits 20, 28 and 32. The cold liquefied natural gas stream condenses excess vapor from tank 10 supplied by conduit 26 to conduit 20 and then flows into heat exchanger 36, wherein it is heated in a controlled manner such that the outlet temperature to conduit 38 is −200° F. The liquefied natural gas supply pressure of 140 psig overcomes the vehicle tank back pressure of 120 psig, plus the pressure drop in heat exchanger 36 and conduits 20, 38, in order to establish flow to the vehicle tank. The bus vehicle tank is thus filled with −200° F. liquefied natural gas and it maintains an operating pressure of near 100 psig at the conclusion of the filling sequence, allowing the bus engine to be started and the bus driven away.

EXAMPLE 2

In one example of the embodiment shown in FIG. 2, liquefied natural gas is withdrawn from the bulk storage tank 10 at the saturation temperature of 231° F. and at 30 psig and increased in pressure by pump 22 to 140 psig. The subcooled liquefied natural gas condenses excess vapor from tank 10 flowing in conduit 26 in conduit 20. The liquefied natural gas flows by means of conduits 281,320 into heat exchanger 36 wherein it is heated in a controlled manner to near its saturation temperature of −189° F., such that vapor and liquid are in saturation equilibrium at 140 psig in vessel 50. Warm liquefied natural gas at 140 psig and about −189° F. in conduit 60 is mixed with cold liquefied natural gas at 140 psig and −231° F. from conduit 64 in control valve 62 to produce liquefied natural gas at 140 psig and −200° F. The liquefied natural gas supply pressure of 140 psig overcomes the vehicle tank back pressure of 120 psig plus the pressure drop due to conduits 60,64 to establish flow, so that the bus can be filled with −200° F. liquefied natural gas while maintaining an operating pressure near 100 psig, permitting the bus to be driven away.

What is claimed is:

1. A method comprising:

withdrawing liquefied natural gas stored in a primary insulated storage tank at a low pressure and at a temperature close to its boiling point;

increasing the pressure of the withdrawn liquefied natural gas and then feeding the pressurized liquefied natural gas through a heat exchanger to warm the liquefied natural gas to a subcooled or near saturated liquid condition at a temperature of about −220° F. to −126° F. when at a pressure of about 50 psig to 550 psig; and feeding the said warmed and pressurized liquefied natural gas to an insulated tank on a vehicle at a refueling facility, said vehicle using liquefied natural gas as its fuel and the insulated vehicle fuel tank being adapted to safely contain and store the said liquefied natural gas in liquid form, at an approximate saturated condition at a temperature of about −220° F. to −126° F. and a pressure of about 50 psig to 550 psig.

2. A method according to claim 1 in which:

natural gas vapor accumulates in the primary insulated storage tank; and natural gas vapor is withdrawn from the primary insulated storage tank and is combined with the liquefied natural gas withdrawn from the primary insulated storage tank, after the pressure on the withdrawn liquefied natural gas has been increased, to form a combined stream which is fed through the heat exchanger.

3. A method according to claim 1 in which:

some of the liquid natural gas withdrawn from the primary storage tank and then increased in pressure is mixed with the warmed and pressurized liquefied natural gas exiting the heat exchanger and the resulting mixture is fed to the vehicle tank.

4. A method according to claim 1 in which the liquefied natural gas in the primary insulated storage tank is at about 15 psia to 45 psia and a temperature of about −258° F. to −230° F.

5. A method according to claim 1 in which:

the heat exchanger is a direct contact heat exchanger and the pressurized liquefied natural gas is warmed therein by direct contact with vapor withdrawn from the primary insulated storage tank.

6. A method comprising:

withdrawing liquefied natural gas stored in a primary insulated storage tank at a low pressure and at a temperature close to its boiling point;

increasing the pressure of the withdrawn liquefied natural gas and the feeding the pressurized liquefied natural gas through a heat exchanger to warm the liquefied natural gas to a near saturated liquid condition at a temperature of about −220° F. to −126° F. when at a pressure of about 50 psig to 550 psig;

feeding the warmed and pressurized liquefied natural gas from the heat exchanger to a stationary insulated natural gas dispensing tank located at a vehicle liquefied natural gas refueling facility and storing the liquefied natural gas in the dispensing tank in an approximate saturated condition at a temperature of about −220° F. to −126° F. and a pressure of about 50 psig to 550 psig; and upon arrival of a vehicle at the refueling facility, said vehicle using liquefied natural gas as its fuel and being equipped with an insulated vehicle tank adapted to safely contain and store liquefied natural gas in liquid form, transferring liquefied natural gas from the dispensing tank to the vehicle fuel tank so that the liquefied natural gas is in an approximate saturated condition at a temperature of about −220° F. to −126° F. and a pressure of about 50 psig to 550 psig.

7. A method according to claim 6 in which:

the liquefied natural gas is delivered to the vehicle tank without a substantial change in temperature and pressure from that at which it is stored in the dispensing tank.

8. A method according to claim 6 in which:

natural gas vapor accumulates in the primary insulated storage tank; and natural gas vapor is withdrawn from the primary insulated storage tank and is combined with the liquefied natural gas withdrawn from the primary insulated storage tank, after the pressure on the withdrawn liquefied natural gas has been increased, to form a combined stream which is fed through the heat exchanger.

9. A method according to claim 6 in which:

vapor forms in the dispensing tank and the vapor is returned to the primary insulated storage tank.

10. A method according to claim 6 in which:

some of the liquefied natural gas withdrawn from the primary storage tank and then increased in pressure is fed into admixture with liquefied natural gas withdrawn from the dispensing tank to form a blended mixture having a controlled temperature and pressure which is fed to the vehicle tank.

11. Amethod according to claim 6 in which:

some of the liquefied natural gas withdrawn from the primary storage tank and then increased in pressure is fed into admixture with the warmed and pressurized liquefied natural gas from the heat exchanger, and then the resulting blended admixture is fed to the dispensing tank.

12. Apparatus comprising:

a primary insulated storage tank containing liquefied natural gas at a pressure close to atmospheric pressure and at a temperature close to its boiling point;

a heat exchanger;

a first conduit communicating with the liquefied natural gas in the primary tank and with the heat exchanger, said conduit including a pump, for withdrawing liquefied natural gas from the primary tank, increasing the pressure of the withdrawn liquefied natural gas and feeding it to the heat exchanger wherein the pressurized liquefied natural gas is warmed to a temperature no more than about −220° F. to −126° F. when at a pressure of about 50 psig to 550 psig;

a vehicle using liquefied natural gas as its fuel and having an insulated fuel tank on board for receiving liquefied natural gas; and a second conduit communicating with the heat exchanger and the vehicle fuel tank for receiving the warmed and pressurized liquefied natural gas from the heat exchanger and feeding it to the vehicle fuel tank for storage as a liquid therein at a temperature of about −220° F. to −126° F. and a pressure of about 50 psig to 550 psig and at an approximate saturated condition.

13. Apparatus according to claim 12 in which:

the primary storage tank has a natural gas vapor space; and a natural gas vapor withdrawal conduit communicates with the primary tank vapor space and with the conduit communicating with the primary tank and with the heat exchanger.

14. Apparatus according to claim 12 comprising:

a third conduit communicating with the first conduit and the second conduit for admixing streams of liquefied gas to be fed through the first and second conduits to the third conduit to form an admixed stream and for delivering the admixed stream to the vehicle fuel tank.

15. Apparatus according to claim 12 in which:

the heat exchanger is a direct contact heat exchanger and the pressurized liquefied natural gas is warmed therein by direct contact with vapor withdrawn from the primary insulated storage tank.

16. Apparatus comprising:

a primary insulated storage tank containing liquefied natural gas at a pressure close to atmospheric pressure and at a temperature close to its boiling point;

a heat exchanger;

a first conduit communicating with the liquefied natural gas in the primary tank and with the heat exchanger, said conduit including a pump, for withdrawing liquefied natural gas from the primary tank, increasing the pressure of the withdrawn liquefied natural gas and feeding it to the heat exchanger wherein the pressurized liquefied natural gas is warmed to a temperature of about −220° F. to −126° F. when at a pressure of about 50 psig to 550 psig and so that the liquefied natural gas is at an approximate saturated condition;

a stationary insulated natural gas dispensing tank located at a vehicle liquefied natural gas refueling facility;

a second conduit for feeding the warmed and pressurized liquefied natural gas from the heat exchanger to the stationary insulated natural gas dispensing tank for storage in the said dispensing tank at an approximate saturated condition and at a temperature of about −220° F. to −126° F. and a pressure of about 50 psig to 550 psig;

a vehicle using liquefied natural gas as its fuel and having an insulated fuel tank on board for receiving liquefied natural gas; and a third conduit communicating with the dispensing tank and the vehicle fuel tank for receiving warmed and pressurized liquefied natural gas from the dispensing tank and feeding it to the vehicle fuel tank for storage therein at a temperature of about −220° F. to −126° F. and a pressure of about 50 psig to 550 psig and at an approximate saturated condition.

17. Apparatus according to claim 16 in which:

the primary storage tank has a natural gas vapor space; and a natural gas vapor withdrawal conduit communicates with the primary tank vapor space and with the conduit communicating with the liquefied natural gas in the primary tank and with the heat exchanger for combining the vapor with the liquefied natural gas.

18. Apparatus according to claim 16 including:

a fourth conduit communicating with the first conduit and the third conduit for feeding pressurized liquefied natural gas into admixture with warm liquefied natural gas withdrawn from the dispensing tank to thereby form a blended stream of liquefied natural gas to feed to the vehicle tank.

19. Apparatus according to claim 16 including:

conduit means for withdrawing natural gas vapor from the dispensing tank and returning it to the primary storage tank.

20. Apparatus according to claim 16 comprising:

a fourth conduit communicating with the first conduit and with the second conduit for feeding pressurized liquefied natural gas into admixture with warm liquefied natural gas withdrawn from the heat exchanger to thereby form a blended stream of liquefied natural gas to feed to the dispensing tank.

* * * * *